US012024759B2

(12) United States Patent
Beals

(10) Patent No.: US 12,024,759 B2
(45) Date of Patent: Jul. 2, 2024

(54) ALUMINUM ALLOY FOR HIGH PRESSURE DIE CASTING APPLICATIONS

(71) Applicants: MAGNA INTERNATIONAL INC., Aurora (CA); Randy S. Beals, Grand Ledge, MI (US)

(72) Inventor: Randy S. Beals, Grand Ledge, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 218 days.

(21) Appl. No.: 17/641,116

(22) PCT Filed: Sep. 10, 2020

(86) PCT No.: PCT/US2020/050114
§ 371 (c)(1),
(2) Date: Mar. 8, 2022

(87) PCT Pub. No.: WO2021/050674
PCT Pub. Date: Mar. 18, 2021

(65) Prior Publication Data

US 2022/0333225 A1 Oct. 20, 2022

Related U.S. Application Data

(60) Provisional application No. 62/898,046, filed on Sep. 10, 2019.

(51) Int. Cl.
*B22D 21/00* (2006.01)
*B22D 18/06* (2006.01)
(Continued)

(52) U.S. Cl.
CPC ..... *C22C 21/02* (2013.01); *B22D 18/06* (2013.01); *B22D 21/007* (2013.01); *C22B 21/0092* (2013.01); *C22C 1/026* (2013.01)

(58) Field of Classification Search
CPC .... B22D 21/007; C22B 21/0092; C22C 1/026
See application file for complete search history.

(56) References Cited

U.S. PATENT DOCUMENTS

2001/0006607 A1 7/2001 Bekki et al.
2008/0006149 A1 1/2008 Kato et al.
2017/0175240 A1 6/2017 Wen et al.

FOREIGN PATENT DOCUMENTS

CA 2968224 A1 11/2017
CN 106811629 A 6/2017
(Continued)

OTHER PUBLICATIONS

Wikipedia, Mass fraction (chemistry), Jun. 19, 2020 (Jun. 19, 2020) [retrieved from internet on Nov. 5, 2020 (Nov. 5, 2020) <https://en.wikipedia.org/wiki/Mass_fraction_(chemistry)>] p. 1.
(Continued)

*Primary Examiner* — Kevin E Yoon
(74) *Attorney, Agent, or Firm* — Dickinson Wright PLLC

(57) ABSTRACT

An improved aluminum alloy for blending with a recycled aluminum alloy to form a material for high pressure vacuum die casting is provided. The improved aluminum alloy includes 10 to 12 wt. % silicon, 0.65 to 0.85 wt. % manganese, less than 0.05 wt. % iron, less than 0.05 wt. % magnesium, 0.2 to 0.4 wt. % strontium, less than 0.05 wt. % titanium, and less than 0.02 wt. % copper, based on the total weight of the improved aluminum alloy. The recycled aluminum alloy typically includes 0.60-1.0 wt. % silicon, ≤0.35 wt. % iron, ≤0.20 wt. % copper, 0.05-0.20 wt. % manganese, 0.40-0.8 wt. % magnesium, ≤0.20 wt. % chromium, ≤0.15 wt. % zinc, ≤0.05 wt. % titanium, ≤0.05 wt. % others (each), and ≤0.15 wt. % others (total). The material meets the specifications for an Aural 5S alloy.

9 Claims, 3 Drawing Sheets

(51) Int. Cl.

| | |
|---|---|
| ***C22B 21/00*** | (2006.01) |
| ***C22C 1/02*** | (2006.01) |
| ***C22C 21/02*** | (2006.01) |

(56) References Cited

FOREIGN PATENT DOCUMENTS

| | | | | |
|---|---|---|---|---|
| CN | 108300910 | A | 7/2018 | |
| GB | 2570026 | A | 7/2019 | |
| JP | H1161312 | A | 3/1999 | |
| WO | WO-2018015492 | A1 * | 1/2018 | ..... C22B 1/24 |
| WO | 2018094535 | A1 | 5/2018 | |
| WO | 2018156902 | A | 8/2018 | |

OTHER PUBLICATIONS

EPO, EP Search Report dated Aug. 10, 2023 for corresponding EP application No. 20862860.2; 9 pgs.

International Preliminary Report on Patentability dated Mar. 24, 2022 for International Application No. PCT/US2020/050114, 8 pages.

Wei Shihe, "Casting Alloy Principle and Smelting", Huazhong University of Science and Technology Press, p. 173, Mar. 31, 1997.

Wang Xiaomin et al., "Magnesium Aluminum Indium Metallurgy and Composite Material Lightweight Thereof", p. 190, Metallurgical Industry Press, Sep. 30, 2018.

Unknown, Novelis Advanz 6HS-e600, Novelis Global Automotive, 1 page, Jan. 21, 2019, accessed at: https://zh-hans.novelis.com/wp-content/uploads/2021/11/Novelis-Advanz%E2%84%A2-6HS-%E2%80%93-e600.pdf; Last accessed May 10, 2023.

* cited by examiner

ALUMINUM ALLOY FOR HIGH PRESSURE DIE CASTING APPLICATIONS

CROSS-REFERENCE TO RELATED APPLICATIONS

This U.S. National Stage Patent Application claims the benefit of PCT International Patent Application Serial No. PCT/US2020/050114 filed Sep. 10, 2020 entitled "ALUMINUM ALLOY FOR HIGH PRESSURE DIE CASTING APPLICATIONS" which claims the benefit of and priority to U.S. Provisional Patent Application Ser. No. 62/898,046 filed on Sep. 10, 2019, and titled "Aluminum Alloy For High Pressure Die Casting Applications," the entire disclosures of which are hereby incorporated by reference.

BACKGROUND OF THE INVENTION

1. Field of the Invention

The invention relates to an improved aluminum alloy, material including a blend of the improved aluminum alloy and a recycled aluminum alloy, a part formed from the material, and methods of manufacturing the same.

2. Related Art

Casting, extruding, and forging are production processes during which a material is melted, shaped, and allowed to cool and solidify into structural part. One material used in such processes is an aluminum alloy, and more particularly, an Aural series aluminum alloy. For example, the Aural 5S alloy exhibits good mechanical properties and good castability (fluidity) due to the ability of the alloy to be heat-treated and precipitation hardened, and thus the Aural 5S alloy is used for structural aluminum high pressure vacuum die casting applications. However, the Aural series aluminum alloys for structural high pressure die castings are more expensive because they are produced at lower volumes, compared to other more established aluminum casting alloys, such as A356, and compared to wrought (sheet, forging, etc.) alloys, such as 6000 series aluminum.

SUMMARY

The invention provides an improved aluminum alloy which can be blended with a recycled aluminum alloy to form a material meeting the specifications for an Aural 5S (C611) alloy chemical composition. The material can be manufactured with reduced costs compared to conventional materials meeting the Aural 5S (C611) alloy specifications.

According to one aspect of the invention, the improved aluminum alloy comprises 10 to 12 wt. % silicon, 0.65 to 0.85 wt. % manganese, less than 0.05 wt. % iron, less than 0.05 wt. % magnesium, 0.2 to 0.4 wt. % strontium, less than 0.05 wt. % titanium, and less than 0.02 wt. % copper, based on the total weight of the improved aluminum alloy.

Another aspect of the invention provides the material formed from the improved aluminum alloy and the recycled aluminum alloy. The improved aluminum alloy includes 10 to 12 wt. % silicon, 0.65 to 0.85 wt. % manganese, less than 0.05 wt. % iron, less than 0.05 wt. % magnesium, 0.2 to 0.4 wt. % strontium, less than 0.05 wt. % titanium, and less than 0.02 wt. % copper, based on the total weight of the improved aluminum alloy. The recycled aluminum alloy includes 0.60 to 1.0 wt. % silicon, ≤0.35 wt. % iron, ≤0.20 wt. % copper, 0.05 to 0.20 wt. % manganese, 0.40 to 0.8 wt. % magnesium, ≤0.10 wt. % chromium, ≤0.15 wt. % zinc, and ≤0.05 wt. % titanium, based on the total weight of the recycled aluminum alloy; or the recycled aluminum alloy includes 0.80 to 1.5 wt. % silicon, 0.05 to 0.2 wt. % iron, 0.01 to 0.11 wt. % wt. % copper, 0.02 to 0.10 wt. % manganese, 0.45 to 0.70 wt. % magnesium, ≤0.10 wt. % chromium, ≤0.25 wt. % zinc, and ≤0.05 wt. % titanium, based on the total weight of the recycled aluminum alloy.

Another aspect of the invention provides a part at least partially formed of the material including the improved aluminum alloy and the recycled aluminum alloy.

Yet another aspect of the invention provides a method of manufacturing the material by blending the improved aluminum alloy and the recycled aluminum alloy.

Another aspect of the invention provides a method of manufacturing the part by casting the material including the improved aluminum alloy and the recycled aluminum alloy.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF EXAMPLE EMBODIMENTS

Example embodiments will now be described more fully with reference to the accompanying drawings. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

One aspect of the invention provides an improved aluminum alloy which can be blended with a recycled aluminum alloy to form material for high pressure die casting applications. For example, the material can be used to form at least a portion of a part by high pressure die casting. According to an example embodiment, the part is a structural component, for example a high vacuum die cast kick down rail casting for a multi-material lightweight vehicle. In the preferred embodiments, the material, including the improved aluminum alloy and the recycled aluminum alloy, meets the specifications for an Aural 5S (C611) alloy chemical composition.

The improved aluminum alloy is a hypoeutectic to eutectic composition and includes 10 to 12 weight percent (wt. %) silicon, 0.65 to 0.85 wt. % manganese, less than 0.05 wt. % iron, less than 0.05 wt. % magnesium, 0.2 to 0.4 wt. % strontium, less than 0.05 wt. % titanium, and less than 0.02 wt. % copper, based on the total weight of the improved aluminum alloy.

The improved aluminum alloy is typically created in ingot form. The improved aluminum alloy is designed to compensate for differences between the recycled aluminum alloy and the composition of the Aural 5S aluminum alloy, so that a mixture of the improved aluminum alloy and the recycled aluminum alloy meets the specifications for an Aural 5S (C611) alloy chemical composition.

Figure 1:
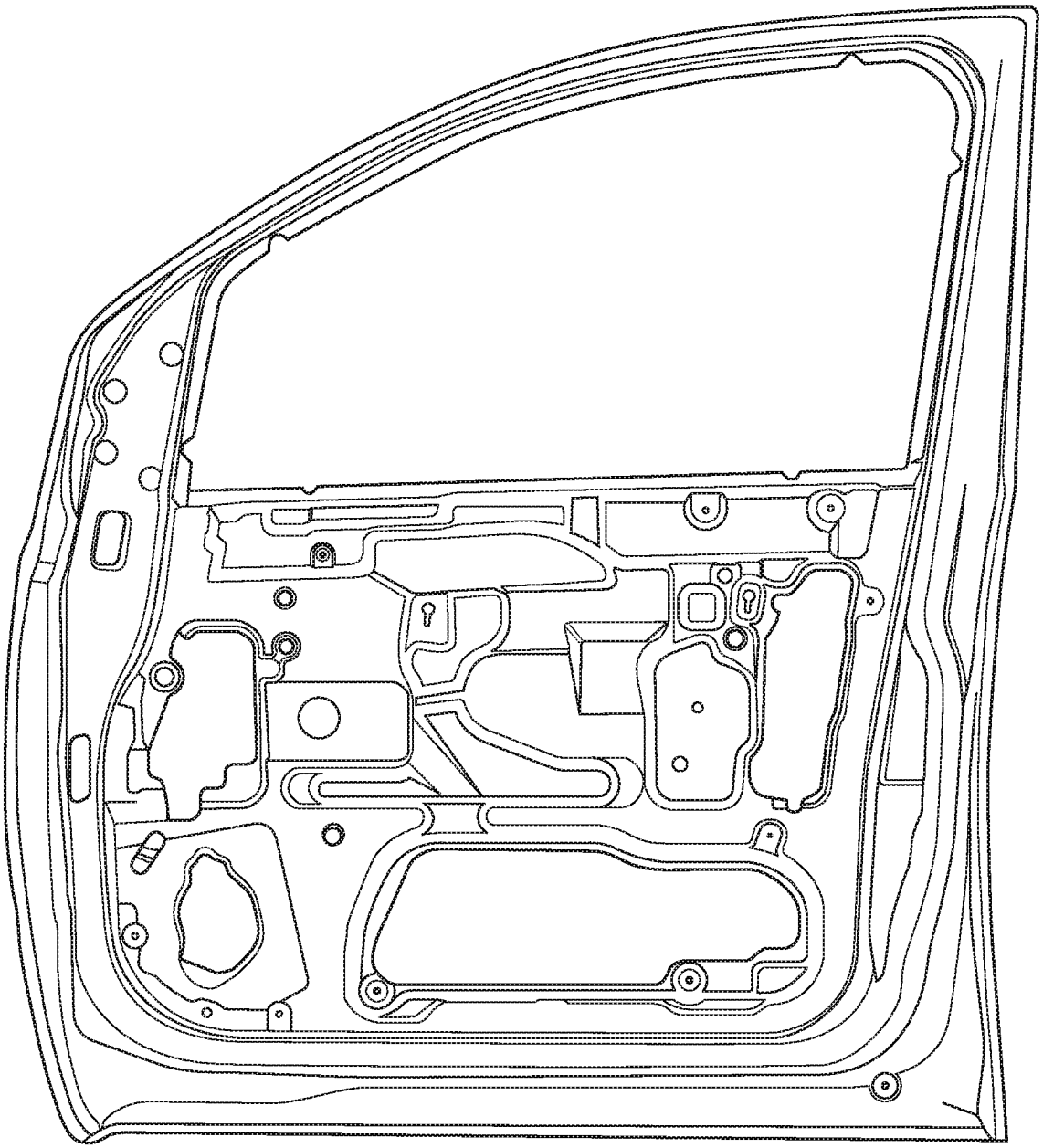
FIG. 1 illustrates an example of a stamped door inner panel formed of a recycled aluminum alloy, wherein the recycled aluminum alloy can be blended with an improved aluminum alloy to form a structural component, according to an embodiment of the invention.

The recycled aluminum alloy is typically lower cost than the improved aluminum alloy and the Aural 5S aluminum alloy. The recycled aluminum alloy is also typically obtained from a sheet, for example scrap from a door panel designed for use in a vehicle. FIG. 1 is a stamped door inner panel formed of the recycled material, and this recycled aluminum alloy can be blended with the improved aluminum alloy to form the structural component.

Figure 2:
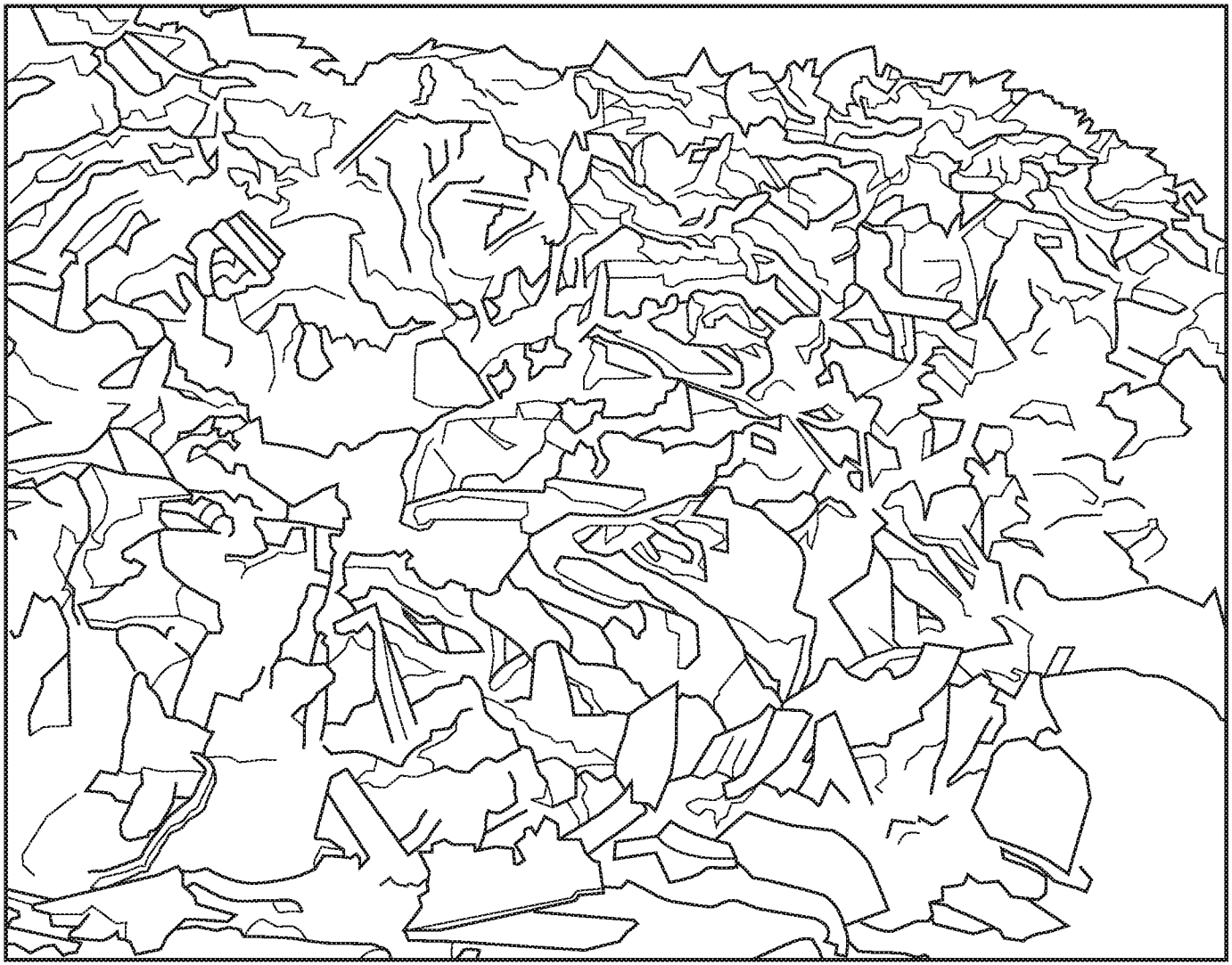
FIG. 2 illustrates stampings formed of the recycled aluminum alloy according to another example embodiment.

FIG. 2 is another example of stampings formed of the recycled aluminum alloy according to an example embodiment.

According to one embodiment, the composition of the recycled aluminum alloy includes 0.60 to 1.0 wt. % silicon, ≤0.35 wt. % iron, ≤0.20 wt. % copper, 0.05 to 0.20 wt. % manganese, 0.40 to 0.8 wt. % magnesium, ≤0.20 wt. % chromium, ≤0.15 wt. % zinc, ≤0.05 wt. % titanium, ≤0.05 wt. % others (each), and ≤0.15 wt. % others (total), based on the total weight of the recycled aluminum alloy.

According to one preferred embodiment, the recycled aluminum alloy is sold under the name Novelis Advanz™ 6HS-e600. According to this embodiment, the recycled aluminum alloy includes 0.60 to 1.0 wt. % silicon, ≤0.35 wt. % iron, ≤0.20 wt. % copper, 0.05 to 0.20 wt. % manganese, 0.40 to 0.8 wt. % magnesium, ≤0.10 wt. % chromium, ≤0.15 wt. % zinc, ≤0.05 wt. % titanium, ≤0.05 wt. % others (each), and ≤0.15 wt. % others (total), based on the total weight of the recycled aluminum alloy. The recycled aluminum alloy, according to this embodiment, has a density of 2.7×10 kg/m$^3$, an elastic modulus of 70,000 N/mm$^2$, a coefficient of thermal expansion of 8.0×10$^3$ kg/m$^3$, a thermal conductivity of 160-190 W/mK, and an electrical conductivity of 26-40 Ω/mm$^2$. According to this embodiment, if the recycled aluminum alloy is used for exterior applications, then after a T4 temper process, the recycled aluminum alloy has a ultimate tensile strength (Rm) at room temperature of at least 230 MPa, a yield strength (Rp0.2) of not greater than 160 MPa, and a total elongation (A80) of at least 22%. According to this embodiment, if the recycled aluminum alloy is used for structure applications, then after a T4 temper process, the recycled aluminum alloy has a ultimate tensile strength (Rm) at room temperature of at least 220 MPa, a yield strength (Rp0.2) of not greater than 160 MPa, and a total elongation (A80) of at least 23%. According to this embodiment, if the recycled aluminum alloy is used for exterior applications, then after a T6 temper process with 2% re-strain for 20 minutes at 185° C., the recycled aluminum alloy has a ultimate tensile strength (Rm) at room temperature of at least 290 MPa, a yield strength (Rp0.2) of not greater than 250 MPa, and a total elongation (A80) of at least 16%.

According to another preferred embodiment, the recycled aluminum alloy is sold under the name Novelis Advanz™ 6HS-s600, and is also referred to as a Novelis AC600 series wrought aluminum. According to this embodiment, the recycled aluminum alloy includes 0.60 to 1.0 wt. % silicon, ≤0.35 wt. % iron, ≤0.20 wt. % copper, 0.05 to 0.20 wt. % manganese, 0.40 to 0.8 wt. % magnesium, ≤0.10 wt. % chromium, ≤0.15 wt. % zinc, ≤0.05 wt. % titanium, ≤0.05 wt. % others (each), and ≤0.15 wt. % others (total), based on the total weight of the recycled aluminum alloy. The recycled aluminum alloy, according to this embodiment, has a density of 2.7×10 kg/m$^3$, an elastic modulus of 70,000 N/mm$^2$, a coefficient of thermal expansion of 8.0×10$^3$ kg/m$^3$, a thermal conductivity of 160-190 W/mK, and an electrical conductivity of 26-40 Ω/mm$^2$. According to this embodiment, if the recycled aluminum alloy is used for exterior applications, then after a T4 temper process, the recycled aluminum alloy has a ultimate tensile strength (Rm) at room temperature of at least 230 MPa, a yield strength (Rp0.2) of not greater than 160 MPa, and a total elongation (A80) of at least 22%. According to this embodiment, if the recycled aluminum alloy is used for structure applications, then after a T4 temper process, the recycled aluminum alloy has a ultimate tensile strength (Rm) at room temperature of at least 220 MPa, a yield strength (Rp0.2) of not greater than 160 MPa, and a total elongation (A80) of at least 23%. According to this embodiment, if the recycled aluminum alloy is used for exterior applications, then after a T6 temper process with 2% re-strain for 20 minutes at 185° C., the recycled aluminum alloy has a ultimate tensile strength (Rm) at room temperature of at least 290 MPa, a yield strength (Rp0.2) of not greater than 250 MPa, and a total elongation (A80) of at least 16%.

Figure 3:
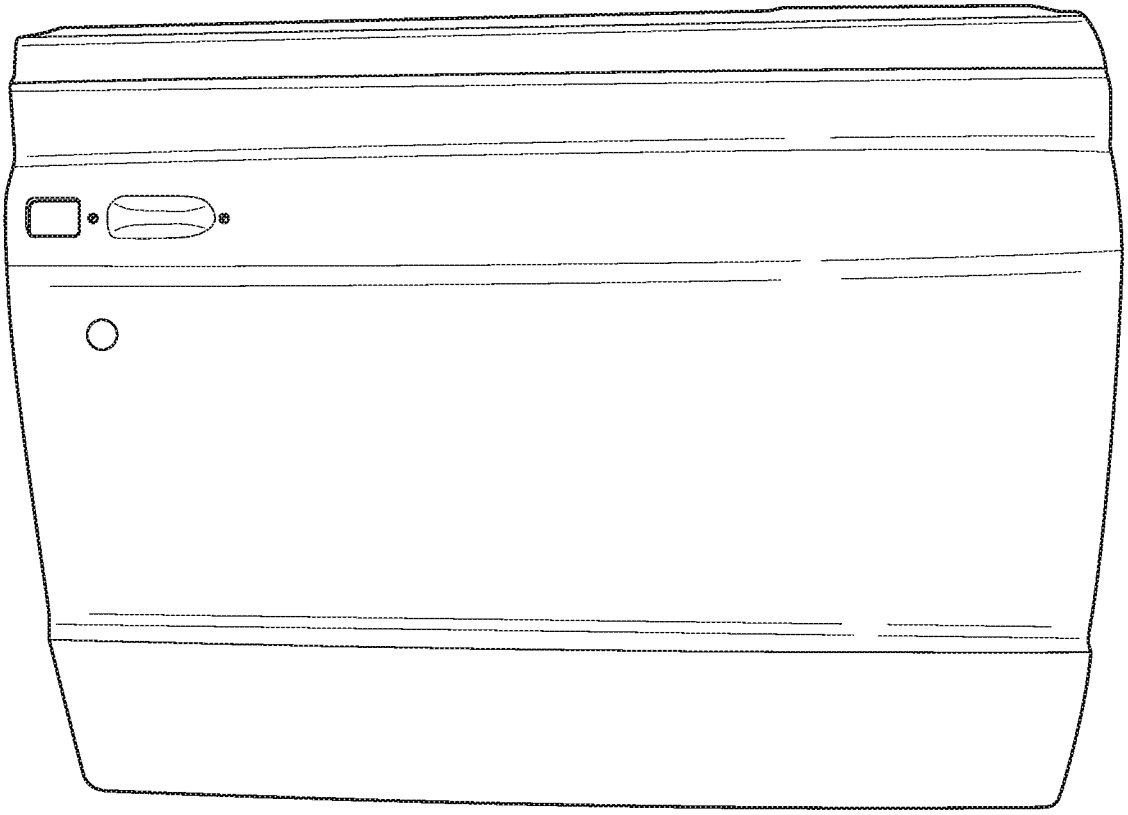
FIG. 3 illustrates an outer panel of an automotive door formed of the recycled aluminum alloy according to another example embodiment.

According to another embodiment, the recycled aluminum alloy is known as 6022 aluminum and is obtained from automotive sheets, for example an automotive door outer panel as shown in FIG. 3. According to this embodiment, the recycled aluminum alloy includes 0.80 to 1.5 wt. % silicon, 0.05 to 0.2 wt. % iron, 0.01 to 0.11 wt. % wt. % copper, 0.02 to 0.10 wt. % manganese, 0.45 to 0.70 wt. % magnesium, ≤0.10 wt. % chromium, ≤0.25 wt. % zinc, and ≤0.05 wt. % titanium, based on the total weight of the recycled aluminum alloy.

The material formed from the improved aluminum alloy and the recycled aluminum alloy can include the improved aluminum alloy in an amount of 55 to 65 wt. % and the recycled aluminum alloy in an amount of 35 to 45 wt. %, based on the total weight of the material. In a preferred embodiment, the improved aluminum alloy and the recycled aluminum alloy are mixed or blended in a ratio of 5 to 3, for example 63 wt. % improved aluminum and 37 wt. % recycled aluminum alloy, based on the total weight of the blend, to achieve a material having a composition which meets the specifications for an Aural 5S (C611) alloy chemical composition. The amounts of silicon in the improved aluminum alloy allows for melting in a commercial stack melting furnace.

The material formed by blending the improved aluminum alloy and the recycled aluminum alloy, which meets the specifications for an Aural 5S alloy composition, includes 6.0 to 8.0 wt. % silicon, 0.40 to 0.60 wt. % manganese, ≤0.25 wt. % iron, 0.10 to 0.60 wt. % magnesium, 0.010 to 0.03 wt. % strontium, ≤0.15 wt. % titanium, ≤0.05 wt. % others (each), and ≤0.15 wt. % others (total), based on the total weight of the material. The Aural 5S alloy, in the T5 temper condition, has a minimum yield strength of 120 MPa (0.2% offset), a minimum ultimate tensile strength (UTS) of 180 MPa, and a minimum elongation of 7%. These properties are achieved by the material formed by blending the improved aluminum alloy and the recycled aluminum alloy.

The material can be used to form at least a portion of the part. According to a preferred embodiment, the part is formed by high pressure vacuum die casting the material. The high pressure vacuum die casting process typically includes casting the material by applying a pressure of 400 to 600 MPa to the material and while the material is under a vacuum. The material is expected to have good castability (fluidity) and good mechanical properties.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed is:

1. A method of manufacturing a material by blending an improved zaluminum alloy and a recycled aluminum alloy, the improved aluminum alloy including 10 to 12 weight percent (wt. %) silicon, 0.65 to 0.85 wt. % manganese, less than 0.05 wt. % iron, less than 0.05 wt. % magnesium, 0.2 to 0.4 wt. % strontium, less than 0.05 wt. % titanium, and less than 0.02 wt. % copper, based on the total weight of the improved aluminum alloy; and the recycled aluminum alloy including 0.60 to 1.0 wt. % silicon, ≤0.35 wt. % iron, ≤0.20 wt. % copper, 0.05 to 0.20 wt. % manganese, 0.40 to 0.8 wt. % magnesium, ≤0.20 wt. % chromium, ≤0.15 wt. % zinc, and ≤0.05 wt. % titanium, based on the total weight of the recycled aluminum alloy; or the recycled aluminum alloy including 0.80 to 1.5 wt. % silicon, 0.05 to 0.2 wt. % iron, 0.01 to 0.11 wt. % wt. % copper, 0.02 to 0.10 wt. % manganese, 0.45 to 0.70 wt. % magnesium, ≤0.10 wt. % chromium, ≤0.25 wt. % zinc, and ≤0.05 wt. % titanium, based on the total weight of the recycled aluminum alloy.

2. The method of claim 1, wherein the recycled aluminum alloy includes other elements each in an amount of not greater than 0.05 wt. % and in a total amount of not greater than 0.15 wt. %, based on the total weight of the recycled aluminum alloy.

3. The method of claim 1, wherein the blending step includes blending the improved aluminum alloy in an amount of 55 to 65 wt. % and the recycled aluminum alloy in an amount of 35 to 45 wt. %, based on the total weight of the material.

4. The method of claim 1, wherein the material includes 6.0 to 8.0 wt. % silicon, 0.40 to 0.60 wt. % manganese, ≤0.25 wt. % iron, 0.10 to 0.60 wt. % magnesium, 0.010 to 0.03 wt. % strontium, ≤0.15 wt. % titanium, ≤0.05 wt. % others (each), and ≤0.15 wt. % others (total), based on the total weight of the material.

5. A method of manufacturing a part, comprising the steps of:

manufacturing a material according to claim 1; and casting the material.

6. The method of claim 5, wherein the casting step includes high pressure vacuum die casting.

7. The method of claim 6, wherein the high pressure vacuum die casting includes applying a pressure of 400 to 600 MPa to the material and while the material is under a vacuum.

8. The method of claim 1, wherein the improved aluminum alloy comprises a hypoeutectic composition.

9. The method of claim 1, wherein the improved aluminum alloy comprises a eutectic composition.

* * * * *